US005461392A

United States Patent [19]

Mott et al.

[11] Patent Number: 5,461,392

[45] Date of Patent: Oct. 24, 1995

[54] TRANSVERSE PROBE ANTENNA ELEMENT EMBEDDED IN A FLARED NOTCH ARRAY

[75] Inventors: Charles J. Mott, El Segundo; Clifton Quan, Arcadia, both of Calif.

[73] Assignee: Hughes Aircraft Company, Los Angeles, Calif.

[21] Appl. No.: 232,918

[22] Filed: Apr. 25, 1994

[51] Int. Cl.[6] ..... H01Q 21/00; H01Q 21/24; H01Q 13/10

[52] U.S. Cl. ..... 343/725; 343/767; 343/705

[58] Field of Search ..... 343/725, 729, 343/767, 705, 776, 770; H01Q 21/00, 21/24, 13/10

[56] References Cited

U.S. PATENT DOCUMENTS

| | | | |
|---|---|---|---|
| 5,220,330 | 6/1993 | Salvail et al. | 343/705 |
| 5,227,808 | 7/1993 | Davis | 343/767 |
| 5,264,860 | 11/1993 | Quan | 343/767 |

OTHER PUBLICATIONS

"A Broadband Stripline Array Element," L. R. Lewis et al., IEEE AP–S Symposium, Jun. 1974, p. 35.

"Broadband Antenna Study," L. R. Lewis et al., Mar. 1975 Final Report, AFCRL–TR–75–0178, AD–A014862.

"The Taper Slot Antenna—A New Integrated Element for Millimeter–Wave Applications," K. S. Yngvesson et al., IEEE Transactions on Microwave Theory and Techniques, vol. 37, No., Feb. 1989, pp. 365–374.

"Radar Cross Section," E. F. Knott et al., Chapter 9, Artech House 1985.

*Primary Examiner*—Donald T. Hajec
*Assistant Examiner*—Hoanganh Le
*Attorney, Agent, or Firm*—Leonard A. Alkov; W. K. Denson-Low

[57] ABSTRACT

Low frequency radiating elements are embedded in a flared notch array. The flared notch array forms a series of parallel troughs in which absorptive loads are placed to reduce the antenna radar cross section. The low frequency radiating elements are embedded in the array transverse to the troughs at or below the level of the absorptive loads, and excite several troughs. The absorptive load material is absorptive in the operating band of the flared notch array, but appears as a relatively low loss dielectric at the lower frequencies of operation of the low frequency radiating elements. The low frequency radiating elements can perform Identify Friend or Foe functions in the UHF and L-band regions of the spectrum, while the flared notch array operates at X-band.

34 Claims, 6 Drawing Sheets

FIG. 1
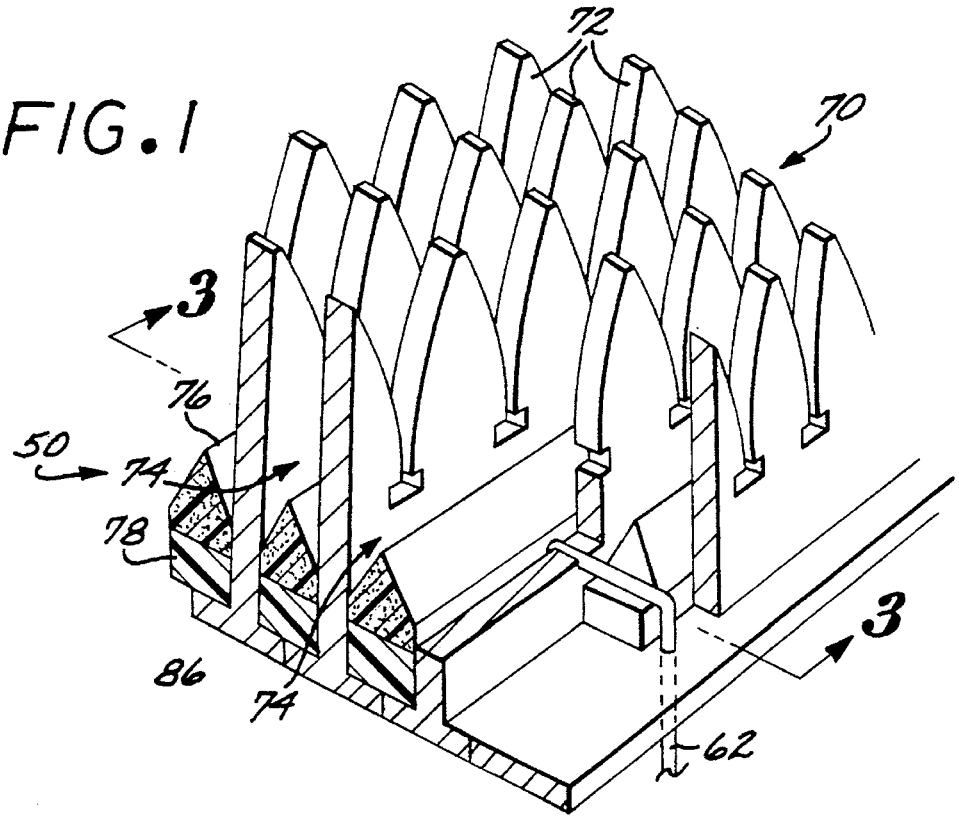
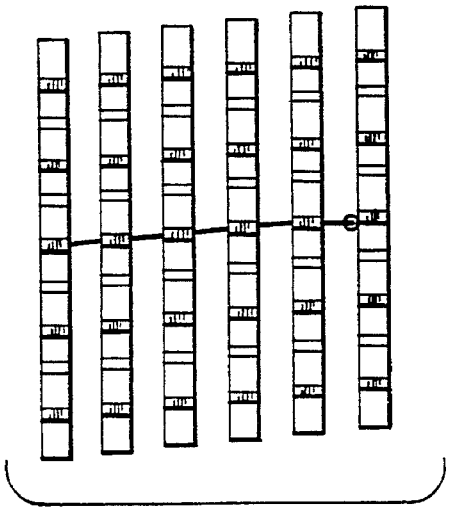
FIG. 4

TRANSVERSE PROBE ANTENNA ELEMENT EMBEDDED IN A FLARED NOTCH ARRAY

TECHNICAL FIELD OF THE INVENTION

This invention relates to antenna arrays, and more particularly to a flared notch array having transverse probe radiating elements embedded therein.

BACKGROUND OF THE INVENTION

Airborne radars typically employ RF phased array antennas. One type of phased array antenna is formed of an array of flared notch radiating elements operating at X-band. For military aircraft, it is desirable to have a low radar cross section (RCS) to reduce aircraft observability.

Aircraft also employ radio transponder equipment to perform Identify Friend or Foe (IFF) functions. Such transponder equipment typically operates at a lower frequency band, e.g., UHF or L-band, than the frequencies of operation of the radar systems.

It would represent an advantage to provide an array of low frequency radiating elements which share aperture area with a flared notch array radar antenna without compromising RCS or the active RF performance of the radar antenna.

SUMMARY OF THE INVENTION

In accordance with one aspect of the invention, an array system is described, wherein an array of flared notch radiator elements share aperture area with an array of transverse probe radiator elements. The flared notch array includes spaced rows of flared notch radiators, arranged to define a series of parallel troughs. The transverse probe elements are disposed transversely through particular ones of the flared notches to extend transversely in a plurality of troughs. The array of flared notches is singly polarized, with the E-field oriented parallel to the troughs. The array of transverse probe elements excite a series of parallel plate waveguide modes which serve as the radiating elements, and which are polarized with the E-fields extending perpendicular to the direction of the troughs. Thus, isolation is achieved due to the orthogonal polarizations, and the two arrays share the same aperture area.

In accordance with another aspect of the invention, an antenna system is described which comprises an array of flared notch radiators, arranged in aligned rows to define a series of parallel troughs between adjacent flared notch radiator rows, the flared notch radiator array operating at a first frequency band. Absorptive loading material is disposed in the troughs, having the characteristic of being absorptive of RF energy in the first frequency band and of appearing as a relatively low loss dielectric at a second frequency band, the second band lower in frequency than the first band. The antenna system further includes means for exciting lower frequency radiation within or under the absorptive loading material, comprising a transverse probe radiating element extending transversely to a plurality of the troughs within or under the absorptive loading material. An array of the transverse probe elements can be embedded in the absorptive loading material. Alternatively, the transverse probes can extend above the cross-polarization load materials, and extend through the high-impedance areas of the flared notch elements.

A preferred application for the antenna system is in an aircraft, wherein the phased array antenna is part of a radar system antenna, and the transverse probe array is used for an Identify Friend or Foe interrogator.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is an isometric, partially broken-away view illustrating an exemplary embodiment of a flared notch array with an embedded transverse probe antenna element.

FIG. 4 is a top view of the array of FIG. 1.

DETAILED DESCRIPTION OF THE PREFERRED EMBODIMENT

Low frequency radiating elements are embedded, in accordance with the invention, in a flared notch array. "Low frequency" in this context means a spectral region below that of the operating band of the flared notch array. A singly-polarised flared notch array naturally forms a series of parallel troughs, and the array E-field is oriented parallel to the troughs. The low frequency radiating elements are probe elements which extend transversely to the troughs, and excite low frequency radiation having an E-field polarization perpendicular to the trough walls. Absorptive loads (sometimes referred to herein as "cross-polarization" loads) can be located in the troughs for the purpose of minimizing antenna radar cross section (RCS). The cross-polarization load material is chosen so as to be absorptive in the operating band of the flared notch array, but appear to be a relatively low loss dielectric at lower frequencies. In one embodiment employing the cross-polarization loads, the transverse probes are embedded in or below the level of the load material. In another embodiment, the transverse probe element extends through the high impedance area of the flared notch, and above the cross-polarization loads.

Figure 2:
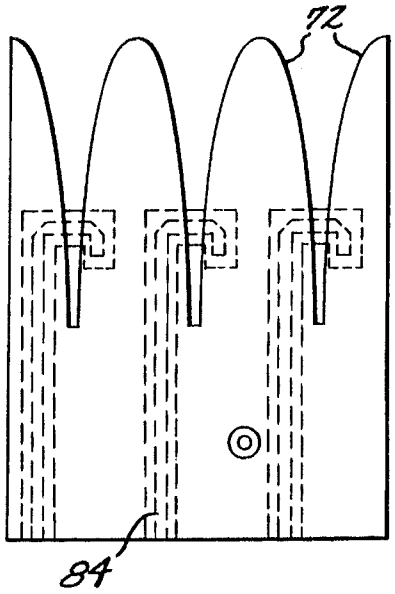
FIG. 2 is a side view of a portion of the array of FIG. 1.
Figure 3:
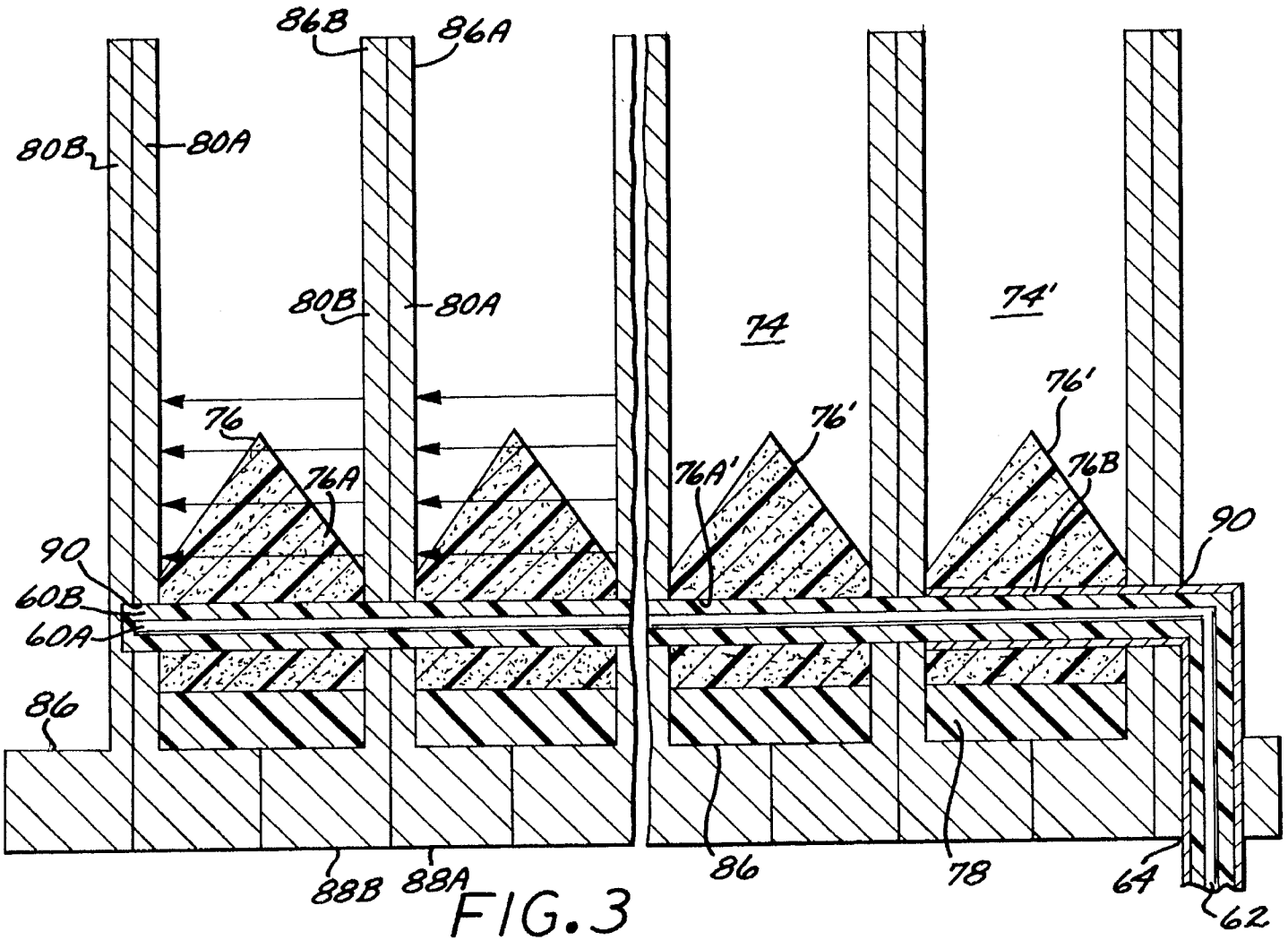
FIG. 3 is a cross-sectional view taken along line 3—3 of FIG. 2.

FIGS. 1–4 show a portion of a dual band antenna system 50, employing one or more transverse probe radiating elements 60 in accordance with the invention. The system 50 includes an array 70 of singly polarized flared notch radiating elements 72. Arrays of flared notch radiating elements are well known in the art. See, e.g., L. R. Lewis et al., "A Broadband Stripline Array Element," IEEE AP-S Symposium, June 1974, page 35; L. R. Lewis et al., "Broadband Antenna Study," March 1975 Final Report, AFCRL-TR-75-0178, AD-A014862; U.S. Pat. No. 5,264,860, "Metal Flared Radiator with Separate Isolated Transmit and Receive Ports," C. Quan. The first two references describe a flared notch radiator as a double sided copper-cladded printed circuit board fed by a stripline balun. The latter reference shows how a balun is incorporated into a metal flared notch. The transverse probe 60 in accordance with this invention can be inserted into arrays of either printed or all metal flared notch radiators. FIGS. 1–3 illustrate an array of all-metal flared notch radiators elements defined by matching strips of metal outer conductive flared notch half-elements. Thus, each strip defines a plurality of flared notch half-elements. Matching strips, e.g., strips 80A and 80B (FIG. 3) are placed together to sandwich the balun feed circuits 84 for the flared notch radiators. In this embodiment, the E field of the flared notch array is oriented in a direction parallel to the trough direction.

The array elements 72 define a plurality of parallel troughs 74 in which is placed the cross-polarization loads 76. In this embodiment, the load material is chosen so as to be absorptive in the operating band of the flared notch array, but appear to be a relatively low loss dielectric at lower frequencies. Suitable materials for the cross-polarization loads are commercially available. For example, the material marketed under the tradename "ECCOSORB CR-117" or "ECCOSORB CR-124" by Emerson & Cuming, may be used for the application wherein the flared notch array radiates at X-band, and the embedded probe antenna operates at or below L-band. This is a ferrite dielectric load material. Other load materials can also be used, e.g., lightweight resistive foam load materials. Each load 76 is placed on a dielectric spacer element 78, in turn placed on the ground plane 86. The dielectric spacers are employed to tune the performance of the cross-polarization loads 76 at the frequency band of operation of the flared notch array, as described, e.g., in *Radar Cross Section*, E. F. Knott et al., Chapter 9, Artech House 1985. Suitable dielectric materials are commercially available, e.g., the material marketed by Emerson & Cuming as "ECCOFOAM PP." The dielectric spacer elements 80 are optional, and can be omitted if it is unnecessary in a particular application to tune the performance of the cross-polarization loads.

The outer conductor surfaces 86A and 86B defined by the flared notch radiator strips 80A and 80B are directly attached to the ground plane 86 of the array. The outer conductor surfaces are extended below the flared notches of the radiators 72 to accommodate the depth of the cross-polarization loads 76 and dielectric spacers 78 between the rows of flared notch radiators. Each matching strip 80A, 80B further includes a base structure 88A, 88B extending at right angles to be flared notch outer conductive surfaces 86A and 86B. The resulting bases of each radiator strip are joined together to form the antenna ground plane 86.

An exemplary probe 60 fed by a coaxial line 62 is transversely passed through several troughs 74 in the flared notch array 70. The probe comprises a metal center conductor 60A and a cylindrical dielectric outer support member 60B. In one exemplary implementation, a center conductor diameter of 0.020 inches, and a dielectric outer member diameter of 0.060 inches has been employed, in an array having a trough width of about 0.3 inches. The width of the flared notch troughs and the dimensions of the probe will depend upon the particular requirement.

The probe 60 is inserted through holes 90 formed in the flared notch radiator elements 72 and through holes 76A formed in the cross-polarization loads 76. The stripline balun 84 feeding the flared notch radiator 72 is shielded from the coaxial transverse probe 60 by the outer conductor halves 80A, 80B that make up the flared notch radiator, as shown in FIG. 2. The holes 90 in which the probe 60 enters the strips of flared notch radiators are metalized, in the case where the flared notch elements are defined by plated dielectric substrates, and the metalization will contact the outer conductor surfaces 86A, 86B that make up the flared notch radiator strip 80. Of course, if the strips are all-metal, no metalization is needed. The probes and associated metalized through holes are located below the stripline-slotline balun transition 92 in the flared notch area and through or underneath the cross-polarization loads 76 to prevent leakage coupling from the flared notch radiator to the exposed probe sections between the flared notch radiator strips. Also, the probes and associated metalized through holes are located away from the flared notch radiator internal circuities to ensure good isolation. Further isolation is provided because the electric fields of the radiator internal circuitry is cross polarized to the electric field of the probes within the radiator strips.

In some applications, it may be desirable or necessary to shield the probe center conductor as it passes through one of the cross-polarization loads. This prevents the associated trough from being excited by the probe and radiating energy from the probe. For example, as shown in FIG. 3, the hole 76A' in load 76' is plated with metalization 76B. Alternatively, the probe outer periphery in trough 74' is shielded by a metallic covering 76B to form a coaxial transmission line extending through a load 76'.

The coaxial feed line 62 is inserted through a hole 64 the ground plane 86 to interconnect with the feed end of the probe 60. The feed line 62 as it extends above the ground plane can be embedded within a pre-cut open region in a cross-polarization load (not shown). The probe can alternatively be fed by microstrip or stripline transmission lines. The feed can be integrated inside the radiator strip if there is room. The probe tip is capacitively terminated into a radiator strip assembly 80A, 80B as shown in FIG. 3. The selection of the particular probe termination is dependent on performance and frequency band of operation.

FIG. 4 shows a simplified top view of the array 50, illustrating the transverse probe 60 in relation to the rows of flared notch radiator elements. Typically, the flared notch radiator elements in one row are offset from corresponding elements in adjacent rows. Consequently, the probe 60 can also include offset segments, so that the probe is not a linear element. Of course, in particular applications the probe may be constructed as a linear element and inserted through the holes 90 and 76A at an angle relative to the flared element strips, rather than orthogonal to the strips.

Figure 5:
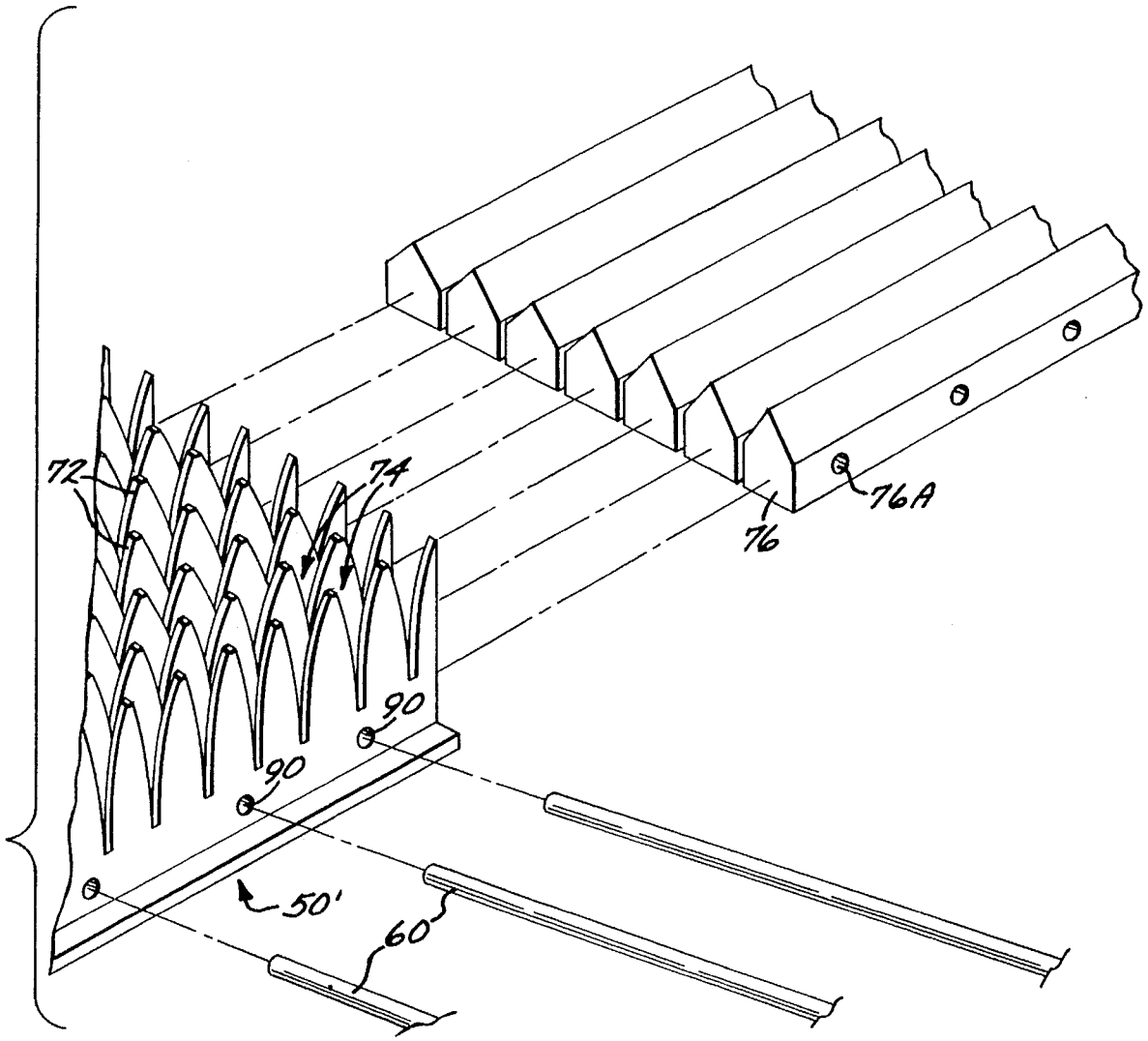
FIG. 5 is a simplified exploded view of an exemplary embodiment of a flared notch array with an array of embedded transverse probe antenna elements.

FIG. 5 is an exploded view of an alternate array 50' in accordance with the invention. This embodiment does not employ the dielectric spacer elements 78 used in the embodiment of FIGS. 1–4. This view shows the cross-polarization loads 76 having the predrilled holes 76A to receive the transverse probe elements 60. After the strips 80 have been assembled together, the loads 76 can be fitted into the troughs 74, and the probes inserted through the holes 90 and 76A. The coaxial feed lines 62 (not shown in FIG. 5) can then be assembled to the probes.

Figure 6:
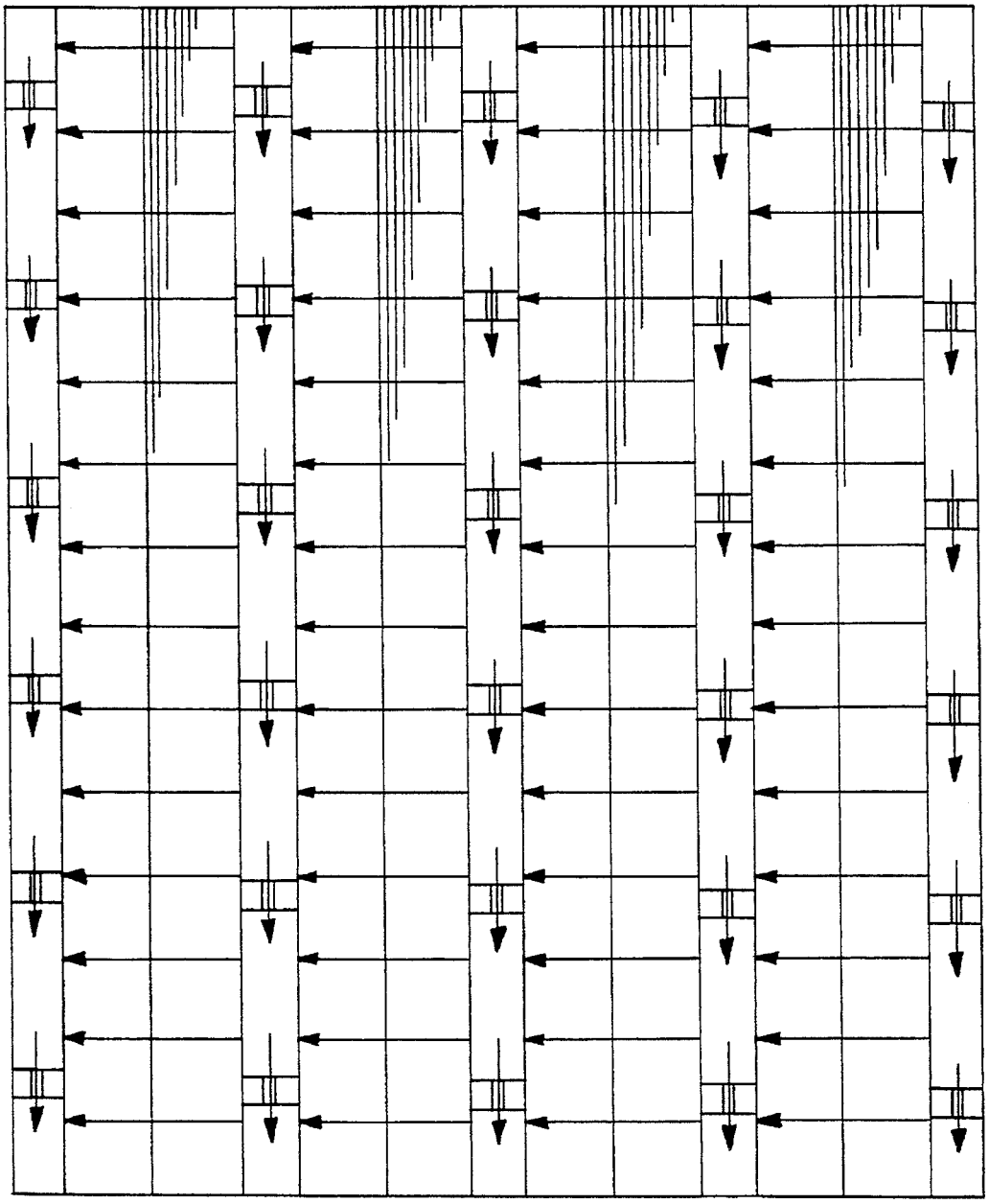
FIG. 6 is a top view of the array of FIG. 5, illustrating the orientation of the electric fields for the flared notch array and the embedded array of transverse probe antenna elements.

The probe 60 when driven by signals in a frequency band below the frequency band at which the cross-polarization load 76 material acts as an absorber will excite a series of parallel plate waveguide modes that form the radiating elements and are cross-polarized to fields radiated by the flared notch radiator strips. This is shown in FIGS. 3 and 6 by the arrows which indicate the direction of the E-field for the parallel plate waveguide modes excited by the transverse probes, and the direction of the E-field for the flared notch radiator element excitation. The fields of the parallel plate waveguide modes are oriented orthogonally to the troughs; the fields of the flared notch excitation is aligned with the flared notch strips. The combination of the parallel plate waveguides formed by the troughs 74 between the flared notch radiator strips 80A, 80B and excited by the coaxial probe 60 create the total embedded radiator assembly.

The probe height above the ground plane 86, the choice of cross-polarization load material and the type of dielectric spacer 78 under the cross-polarization load 76 are selected to optimize low-band RF performance and aperture radar cross-section (RCS). The selection of these parameters involve trade-offs. RCS is improved by moving the probe closer to the ground plane; radiation efficiency of the transverse probe 60 is enhanced by moving in the opposite direction.

The probe 60 is believed to act in a manner analogous to a probe transition element in a waveguide, to excite radiation in the waveguide. The troughs in the flared notch array acts somewhat like waveguides to the excitation of the probe 60. Moreover, the excitation of the probe at lower frequencies does not affect the operation of the flared notch array, since the flared notch array and the probe are orthogonally polarized.

An important feature of the transverse probe 60 is that it excites multiple troughs 74 in the flared notch array 70. Experiments have shown that when just a single trough is excited, undesirable element patterns result at certain frequencies. This is believed to be a consequence of the fact that the flared notch troughs are very close together in terms of a wavelength at low frequencies, and therefore a strong coupling between adjacent troughs is theoretically known to occur.

A typical application will employ a plurality of transverse probe elements forming a probe element array embedded within the flared notch array. There are many possible geometries for the probe elements. The actual size of the antenna and the number of embedded transverse probes will vary according to the requirements of the particular application.

An advantage of this invention is that it allows an array of low frequency radiating elements to share aperture area with an X-band flared notch radar antenna without compromising RCS or active RF performance of the radar antenna. One exemplary use of such an array is to perform Identify Friend or Foe (IFF) functions in the UHF and L-band regions of the spectrum. Other low frequency radiating elements (dipoles, spirals, large flared notches, etc.) do not lend themselves to an embedded installation exhibiting low RCS.

A secondary advantage of the low frequency radiating element, a transverse probe which pierces through several flared notch troughs, is that it exhibits intrinsic broad bandwidth (2:1 or greater). This implies a non-resonant radiative mechanism and a certain amount of flexibility and margin in the RF and mechanical design.

In general, gain of the transverse probe array will be somewhat lower than would be expected for an ideal dipole array. The low gain is due to radiation loss rather than input reflection, which itself is quite low. Even though RF performance is less than perfect, the transverse probe element is still useful from a system standpoint, e.g., for an IFF function.

Figure 7:
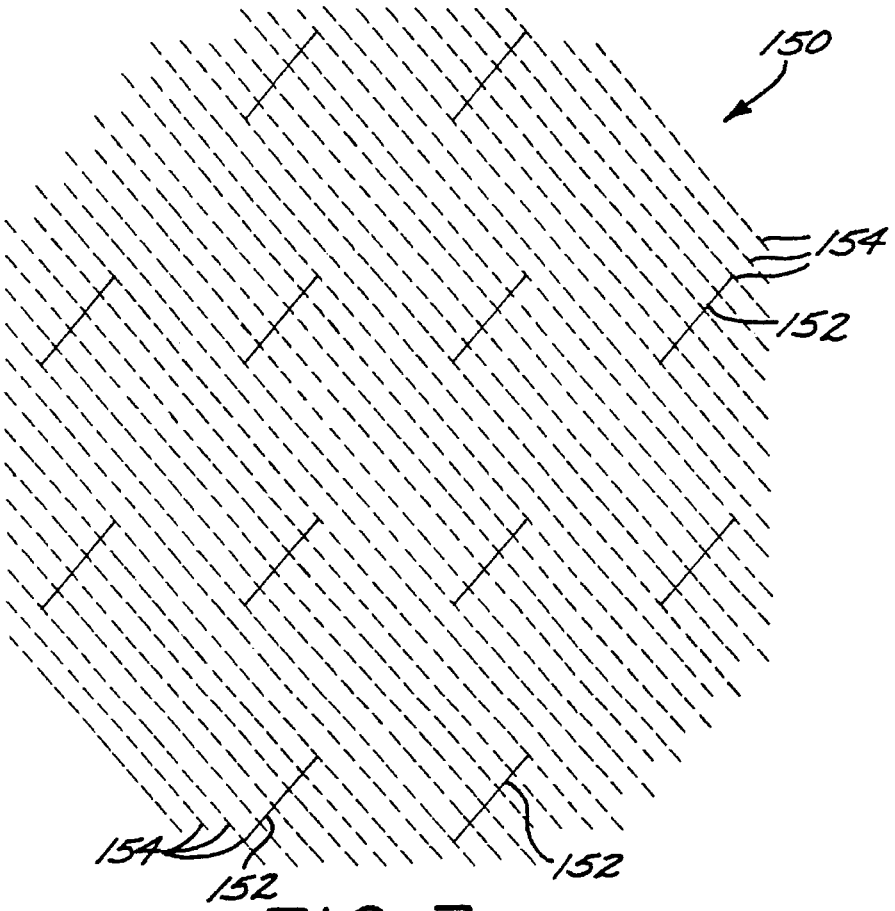
FIG. 7 is a simplified schematic diagram illustrating an exemplary configuration of an array of probe elements embedded in a flared notch array.

FIG. 7 shows an exemplary configuration of a dual array 150, showing how the transverse probe elements can be embedded in an array of twelve flared notch elements 154. Generally the more probe antennas are employed in the probe array, the greater the gain and control of sidelobes.

Figure 8:
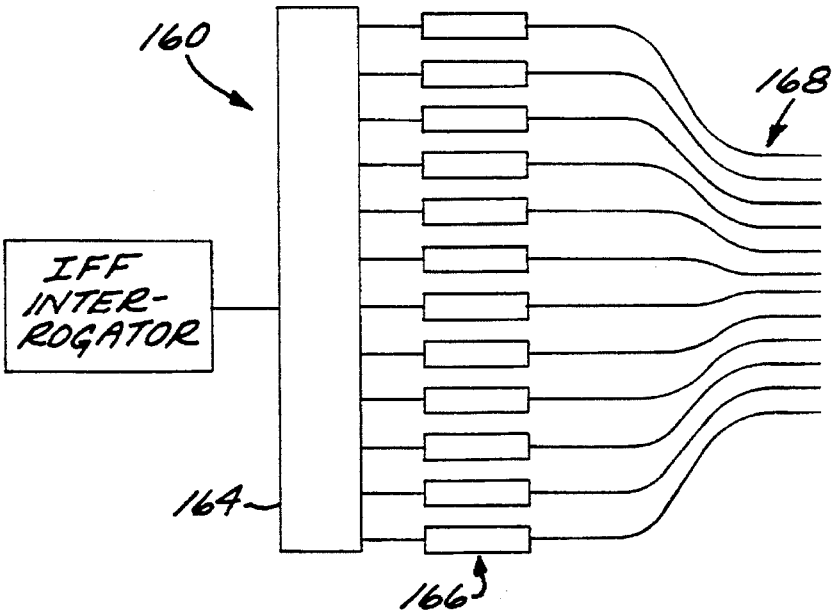
FIG. 8 is a simplified schematic of an exemplary feed network for feeding the transverse probe array of the system of FIG. 7.

FIG. 8 shows an exemplary feed network 160 for feeding the transverse probe elements 152 comprising the array system 150 of FIG. 7. This network 160 is for an IFF application, and comprises an IFF interrogator 162, a power division network 164, a number of phase shift modules 166 (one each for each probe element) and coaxial feed lines 168 routed to the transverse probe elements 152 embedded in the flared notch array of FIG. 7. The power division network 164 is a conventional N-way power divider with an amplitude taper chosen to achieve desired sidelobe levels. The phase shifter elements are included to steer the IFF beam, and may be purely passive elements, or include transmit and/or receive gain.

Figure 9:
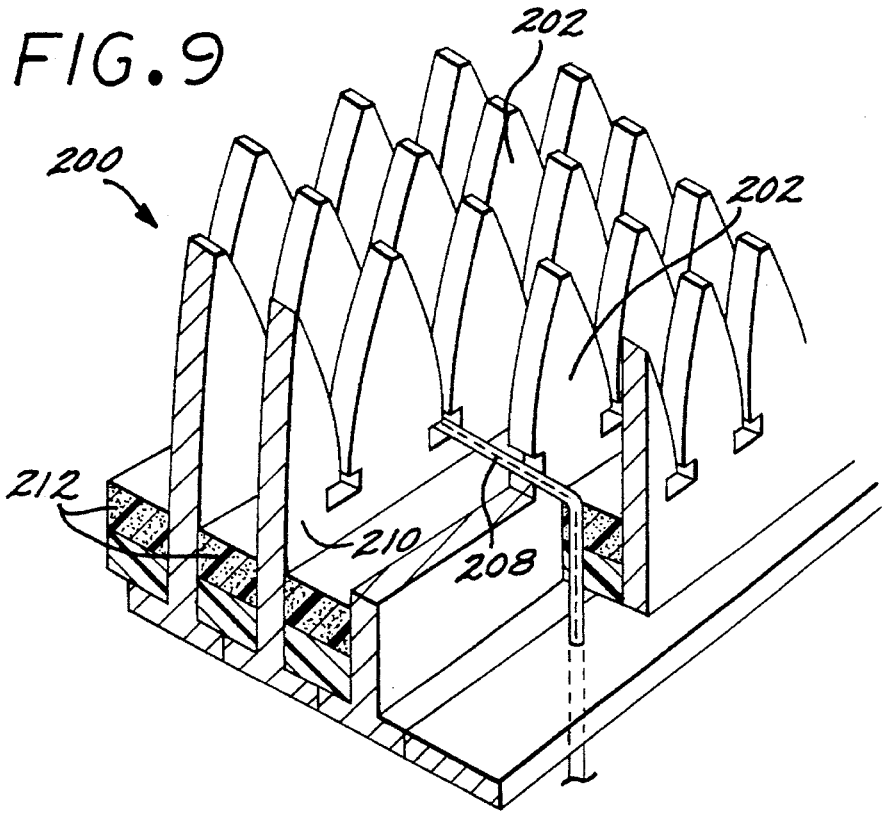
FIG. 9 is a simplified isometric view of an alternate embodiment of a dual array system in accordance with the invention.
Figure 10:
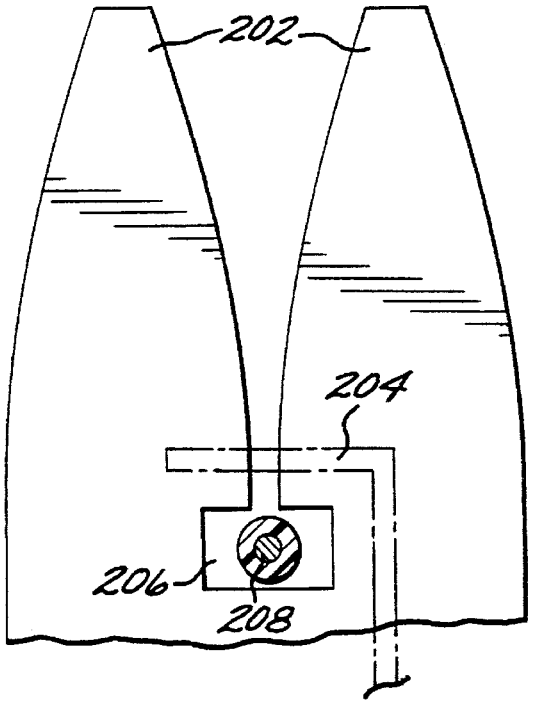
FIG. 10 is a side view of a flared notch element and transverse probe element of the array system of FIG. 9.

FIGS. 9 and 10 illustrate a further embodiment of the invention. In this implementation, the flared notch elements 202 include a high impedance region 206 at the bottom of the flared notch and below the balun 204. The transverse probe elements 208 are passed through the high impedance regions 206 of the flared notch elements and through the troughs 210 in the flared notch array above the cross-polarization load 212. The advantage of this implementation is that the fabrication of the system 200 is simpler than the fabrication of system 50; however, the radar cross-section of the system is not as intrinsically low as that of the system 50. This is due to the fact that the probe elements are not embedded within the load. Lightweight graded foam loads can be employed as the load material. This embodiment of the invention is useful with the type of flared notch radiator having the high impedance region. Since the transverse probe elements are not embedded in the loads, the frequency of operation of the transverse probe array could be selected to be in the same frequency band of the flared notch array for some applications, since the two arrays are cross-polarized.

It is understood that the above-described embodiments are merely illustrative of the possible specific embodiments which may represent principles of the present invention. For example, while the invention has been described in the context of a system which employs the cross-polarization load material, some applications may not require the low RCS benefit of such loading, and thereby omit the cross-polarization loads. In this case, an array system is obtained having dual array which are singly polarized orthogonally to each other. The frequency bands of operation may vary from those described above, and the flared notch array and transverse probe array need not operate at different frequency bands if the probe element is above the cross-polarization loads, or if the loads are omitted. Other arrangements may readily be devised in accordance with these principles by those skilled in the art without departing from the scope and spirit of the invention.

What is claimed is:

1. An antenna system comprising:

an array of flared notch radiators, arranged in aligned rows to define a series of parallel troughs between adjacent flared notch radiator rows within an aperture area, said array polarized in a first sense aligned with said rows: and a transverse probe radiating element extending transversely through a plurality of said troughs to excite a series of parallel plate waveguide modes which are polarized orthogonally to the polarization sense of said array of flared notch radiators, and wherein said transverse probe element shares said aperture area.

2. The antenna system of claim 1 further comprising RF distribution means for feeding said transverse probe radiating element.

3. The antenna system of claim 1 wherein said flared notch array operates at a first operating frequency band, said probe antenna element operates at a second operating frequency band, said first band is at X-band and said second band is at or below L-band.

4. The antenna system of claim 1 wherein said transverse probe element forms a part of an array of a plurality of transverse probe elements each extending through a plurality of said troughs, said array of transverse probe elements sharing said aperture area.

5. The antenna system of claim 1 wherein said system is mounted in an aircraft, said array of flared notch radiators comprises a radar system antenna, and said transverse probe element is part of an Identify Friend or Foe transponder system.

6. The antenna system of claim 1 wherein said flared notch radiators each comprise a high impedance region at a bottom of a flared notch, and said transverse probe element is inserted transversely through said high impedance region of a plurality of said flared notch radiators.

7. The antenna system of claim 1 wherein said transverse probe element comprises a conductive center conductor and a dielectric outer element.

8. The antenna system of claim 7 wherein said transverse probe element is capacitively terminated at a flared notch radiator.

9. The antenna system of claim 1 further comprising a ground plane, and said flared notch radiators extending generally orthogonally to said ground plane.

10. An antenna system comprising:

an array of flared notch radiators, arranged in aligned rows to define a series of parallel troughs between adjacent flared notch radiator rows within an aperture area, said array polarized in a first sense aligned with said rows:

absorptive RF loading material disposed in said troughs; and a transverse probe radiating element extending transversely through a plurality of said troughs to excite a series of parallel plate waveguide modes which are polarized orthogonally to the polarization sense of said array of flared notch radiators, and wherein said transverse probe element shares said aperture area.

11. The antenna system of claim 10 further comprising RF distribution means for feeding said transverse probe radiating element.

12. The antenna system of claim 10 wherein said probe element is embedded in said absorptive load material within said troughs, and said load material is absorptive of RF energy in a first frequency band and appears as a relatively low loss dielectric at a second frequency band, said second band lower in frequency than said first band.

13. The antenna system of claim 10 wherein said flared notch array operates at said a operating frequency band, said probe antenna element operates at a second operating frequency band, said first band is at X-band and said second band is at or below L-band.

14. The antenna system of claim 10 wherein said transverse probe element forms a part of an array of a plurality of transverse probe elements each extending through a plurality of said troughs, said array of transverse probe elements sharing said aperture area.

15. The antenna system of claim 10 wherein said system is mounted in an aircraft, said array of flared notch radiators comprises a radar system antenna, and said transverse probe element is part of an Identify Friend or Foe transponder system.

16. The antenna system of claim 10 wherein said flared notch radiators each comprise a high impedance region at a bottom of a flared notch, and said transverse probe element is inserted transversely through said high impedance region of a plurality of said flared notch radiators.

17. The antenna system of claim 16 wherein said transverse probe element extends above said absorptive loading material disposed in said troughs.

18. The antenna system of claim 10 wherein said transverse probe element comprises a conductive center conductor and a dielectric outer element.

19. The antenna system of claim 18 wherein said transverse probe element is capacitively terminated at a flared notch radiator.

20. The antenna system of claim 10 further comprising a ground plane, said flared notch radiators extending generally orthogonally to said ground plane, and wherein said load material is disposed adjacent said ground plane.

21. An antenna system comprising:

conductive means defining an array ground plane;

an array of flared notch radiators extending generally orthogonally to said ground plane, arranged in aligned rows to define a series of parallel troughs between adjacent flared notch radiator rows within an array aperture area, said flared notch radiator array operating at a first frequency band:

absorptive RF loading material disposed in said troughs adjacent said ground plane, said material having the characteristic of being absorptive of RF energy in said first frequency band and of appearing as a relatively low loss dielectric at a second frequency band, said second band lower in frequency than said first band; and means for exciting lower frequency radiation within or under said absorptive loading material, said means comprising a transverse probe radiating element extending transversely through a plurality of said troughs within or under said absorptive loading material, said transverse probe element sharing said aperture area.

22. The antenna system of claim 21 wherein said lower frequency exciting means further comprises coaxial feed means for feeding said transverse probe radiating element.

23. The antenna system of claim 21 wherein said first operating frequency band is at X-band, and said second operating frequency band is at or below L-band.

24. The antenna system of claim 21 wherein said means for exciting lower frequency radiation comprises a plurality of transverse probe elements each extending through a plurality of said troughs.

25. The antenna system of claim 21 wherein said system is mounted in an aircraft, said array of flared notch radiators comprises a radar system antenna, and said means for exciting lower frequency radiation comprises an Identify Friend or Foe interrogator.

26. The antenna system of claim 21 further comprising dielectric spacer means disposed between said absorptive material and said ground plane.

27. The antenna system of claim 21 wherein said transverse probe element comprises a conductive center conductor and a dielectric outer element.

28. The antenna system of claim 27 wherein said transverse probe element is capacitively terminated at a flared notch radiator element.

29. A dual band airborne antenna system comprising:

conductive means defining an array ground plane;

an array of flared notch radiators extending generally orthogonally to said ground plane, arranged in aligned rows to define a series of parallel troughs between adjacent flared notch radiator rows within an array aperture area, said flared notch radiator array operating at a first frequency band:

absorptive loading material disposed in said troughs adjacent said ground plane, said material having the characteristic of being absorptive of RF energy in said first frequency band and of appearing as a relatively low loss dielectric at a second frequency band, said second band lower in frequency than said first band; and Identify Friend or Foe (IFF) interrogation means, comprising an array of transverse probe radiating elements, each extending transversely through a plurality of said troughs within or under said absorptive loading material, said transverse probe array sharing said aperture area, and an IFF interrogator coupled to said transverse probe array through an IFF signal distribution network.

30. The antenna system of claim 29 wherein said IFF signal distribution network includes a power divider network connected to said interrogator and a plurality of phase shifters coupled between said power divider network and said transverse probe elements to steer a beam developed by said probe array to a desired direction.

31. The antenna system of claim 29 wherein said first operating frequency band is at X-band, and said second operating frequency band is at or below L-band.

32. The antenna system of claim 29 further comprising dielectric spacer means disposed between said absorptive material and said ground plane.

33. The antenna system of claim 29 wherein said transverse probe elements each comprises a conductive center conductor and a dielectric outer element.

34. The antenna system of claim 33 wherein each said transverse probe element is capacitively terminated at a flared notch radiator.

* * * * *